United States Patent [19]

Gutek et al.

[11] Patent Number: 4,489,127

[45] Date of Patent: Dec. 18, 1984

[54] FLEXIBLE SILICONE RESIN COATED FABRIC

[75] Inventors: Beth I. Gutek, Freeland, Mich.; Bernard Van Wert, Norcross, Ga.

[73] Assignee: Dow Corning Corporation, Midland, Mich.

[21] Appl. No.: 513,503

[22] Filed: Jul. 13, 1983

[51] Int. Cl.[3] ..... B32B 7/00

[52] U.S. Cl. ..... 428/266; 427/381; 427/387; 427/389.8; 427/412; 428/268; 428/447; 428/448

[58] Field of Search ..... 428/266, 268, 447, 448; 524/267; 427/412, 381, 387, 389.8

[56] References Cited

U.S. PATENT DOCUMENTS

| | | | |
|---|---|---|---|
| 3,373,053 | 3/1968 | Clark | 117/126 |
| 3,639,155 | 2/1972 | Hartlein et al. | 117/138.8 A |
| 4,292,362 | 9/1981 | Marwitz et al. | 428/266 |

*Primary Examiner*—James J. Bell
*Attorney, Agent, or Firm*—Edward C. Elliott

[57] ABSTRACT

The method of this invention produces a silicone resin-coated fabric comprising an elastoplastic organopolysiloxane resin coated silicone elastomer membrane reinforced with fabric. The elastoplastic organopolysiloxane resin and the silicone elastomer membrane form an interface which is an adhesive bond derived from a combination comprising (i) polydiorganosiloxane of the formula $X(R_2SiO)_aSiR_2X$, (ii) a hydroxyl radical containing, solid, benzene soluble resin copolymer consisting essentially of $R_3SiO_{\frac{1}{2}}$ units and $SiO_{4/2}$ units, and (iii) a condensation catalyst for (i) and (ii). The bond between the layers of the silicone resin-coated fabric is of such a quality that the silicone resin-coated fabric can be adhesively bonded to itself, or another surface, to produce useful structures such as air supported roofs or tension supported roofs.

24 Claims, 4 Drawing Figures

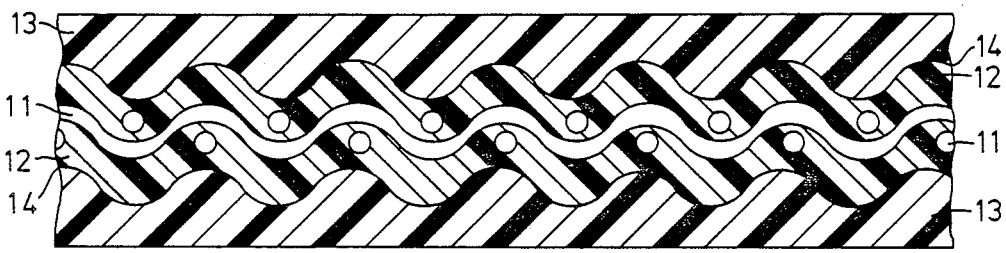

FLEXIBLE SILICONE RESIN COATED FABRIC

BACKGROUND OF THE INVENTION

1. Field of the Invention

This invention relates to fabric coated with polyorganosiloxanes which is useful as architectural fabric for use in structures such as air supported and tension supported roofs.

INFORMATION PERTAINING TO THE INVENTION

In U.S. Pat. No. 3,373,053, issued Mar. 12, 1968, Clark teaches a transparent sheet material consisting essentially of square woven glass cloth coated and impregnated with a cured methylphenylpolysiloxane having from 45 to 55 percent by weight phenyl groups. The ratio of phenyl to silicon groups and phenyl to alkyl groups was chosed to yield a resin having a particular refractive index so that the coated cloth was transparent. The ratio of total hydrocarbon groups to silicon atoms was chosen to obtain the desired flexiblity of the cured coated cloth.

Similar types of silicone resins were coated upon glass fabric and evaluated as glazing for greenhouses. The resin coated cloth showed excellent resistance to weathering, but the cloth was too stiff. Other types of silicone resins were evaluated including those disclosed in U.S. Pat. No 3,639,155, issued Feb. 1, 1972 to Hartlein and Vincent. They had developed the resin as a coating for silicone rubber to prevent the silicone rubber from becoming coated with atmospheric dirt.

Glass fabric coated with silicone resin proved to have a long life when exposed to sunlight, but the glass fabric sizing became colored and light transmission fell off. When the sizing was removed and heat-cleaned glass fabric was used, the transparency remained, but the coated fabric had poor tear strength and flex resistance.

Multi-layered coated fabric was then developed which used a thin coating of clear silicone rubber over the glass fibers to protect them and then used a coating of flexible silicone resin over the rubber to give a surface which did not attract and hold dirt from the air. This type of multi-layered cloth was used to construct a greenhouse by attaching pieces of the coated cloth to a framework and sealing the joints with a silicone room temperature curing sealant.

SUMMARY OF THE INVENTION

This invention relates to silicone resin-coated fabric having a coating, under the resin, of silicone elastomer impregnating and coating the fabric yarn to protect it and form a membrane. The silicone elastomer at the interface between the silicone elastomer and the silicone resin comprises the product obtained by mixing a hydroxyl radical containing, solid, benzene soluble resin copolymer, a condensably endblocked polydiorganosiloxane, and a condensation catalyst. The silicone elastomer at the interface, having the above ingredients, yields an improved adhesive bond between the silicone elastomer membrane and the silicone resin. The silicone resin is an elastoplastic organopolysiloxane resin which is the cured product obtained by exposing to atmospheric moisture a composition comprising an organosiloxane block copolymer. Because of the improved bond between the elastoplastic organopolysiloxane resin and the silicone elastomer under it, it is feasible to bond pieces of the silicone resin-coated fabric together by the use of adhesives.

It is an object of this invention to produce a silicone resin-coated fabric having sufficient adhesion between the elastoplastic organopolysiloxane resin forming the surface of the coated fabric and the silicone elastomer under the elastoplastic organopolysiloxane resin to permit the joining of pieces of the fabric to each other by means of an adhesive.

It is an object of this invention to produce a silicone resin-coated fabric which has improved tear strength and resistance to folding and creasing while maintaining sufficient bond between the layers of the silicone resin-coated fabric to allow pieces of the silicone resin-coated fabric to be adhesively bonded together.

BRIEF DESCRIPTION OF THE DRAWINGS

FIG. 1 is a cross-section of a fabric coated with a layer of silicone elastomer which is overcoated with a layer of elastoplastic organopolysiloxane resin.

FIG. 2 is a cross-section of a fabric coated as in FIG. 1 in which the layer of silicone elastomer comprises two separate coats.

FIG. 3 is a cross-section of the fabric of FIG. 2 showing the first coat of silicone elastomer coating the fabric yarn and the second coat of elastomer filling the interstices between the coated yarns.

FIG. 4 is a cross-section of a fabric in which two coats of silicone elastomer are applied as in FIG. 3, then a primer coat is applied to the elastomer coat with the elastoplastic organopolysiloxane resin applied over the primer coat.

DESCRIPTION OF THE INVENTION

The invention relates to a silicone resin-coated fabric comprising an elastoplastic organopolysiloxane resin coated silicone elastomer membrane reinforced with fabric, the elastoplastic organopolysiloxane resin and the silicone elastomer membrane forming an interface which is an adhesive bond derived from a combination comprising (i) polydiorganosiloxane of the formula $X(R_2SiO)_aSiR_2X$ where R is a monovalent hydrocarbon radical containing no more than 6 carbon atoms, X is a condensable endblocking group, and a has a value such that the polydiorganosiloxane has a viscosity of greater than 1 Pa.s at 25° C.; (ii) a hydroxyl radical containing, solid, benzene soluble resin copolymer consisting essentially of $R_3SiO_{\frac{1}{2}}$ units and $SiO_{4/2}$ units where R is as defined above, there being from 0.6 to 0.9 inclusive $R_3SiO_{\frac{1}{2}}$ unit for every $SiO_{4/2}$ unit, at least 95 percent of all R radicals in (ii) being methyl; and (iii) a condensation catalyst for (i) and (ii).

This invention relates to a method of producing a silicone resin-coated fabric comprising coating a fabric with sufficient curable silicone elastomer composition to form a continuous coating over the fabric, the surface of the coating being a combination comprising (i) polydiorganosiloxane of the formula $X(R_2SiO)_aSiR_2X$ where R is a monovalent hydrocarbon radical containing no more than 6 carbon atoms, X is a condensable endblocking group, and a has a value such that the polydiorganosiloxane has a viscosity of greater than 1 Pa.s at 25° C.; (ii) a hydroxyl radical containing, solid, benzene soluble resin copolymer consisting essentially of $R_3SiO_{\frac{1}{2}}$ units and $SiO_{4/2}$ units where R is as defined above, there being from 0.6 to 0.9 inclusive $R_3SiO_{\frac{1}{2}}$ units for every $SiO_{4/2}$ unit, at least 95 percent of all R radicals in (ii) being methyl, and (iii) a condensation catalyst for (i) and (ii); curing the coating to form a membrane; then coating the membrane with an elastoplastic organopolysiloxane resin thus forming an interface between the membrane and the resin; and finally, curing the resin.

In the development of fabric coated with polyorganosiloxanes for uses such as glazing for green houses, a product consisting of an elastoplastic organopolysiloxane resin coated upon glass fiber fabric was developed and tested. It proved to be sufficiently transparent to sunlight and very resistant to weathering, but the resin coated fabric was too stiff with poor tear strength and crease resistance. When a similar construction was evaluated, using a heavier glass fabric, as a possible material for structural uses such as air supported or tension supported roofs, the thicker resin layer was found to be too brittle as it cracked in use. An improved, more flexible, coated fabric was then developed by first coating the fabric with silicone elastomer to coat the yarns in the fabric, then overcoating the cured silicone elastomer with a thin layer of the resin. In this type of construction sufficient silicone elastomer was coated onto the fabric so that a continuous membrane was formed, that is, the interstices of the fabric between the yarns were filled so that there was no opening present from one side of the coated fabric to the other. The elastoplastic organopolysiloxane resin was then coated over the silicone elastomer, but the bond at the interface between the resin and the elastomer was found to be too weak to allow pieces of the silicone resin coated fabric to be adhesively bonded to each other, wherein seams were made by adhesively bonding two pieces of the resin coated fabric together by overlapping the edges and bonding with a silicone adhesive. The seam failed when stressed by the elastoplastic organopolysiloxane resin coming loose from the silicone elastomer under it. On constructions not having the interstices of the fabric closed by silicone elastomers, there was no such problem. In such constructions, the outer coating of resin on each side extended through the open interstices, thereby bonding the two layers of resin together.

The method of this invention and the silicone resin-coated fabric resulting from the method was developed to solve the problem of adhesion between coats of coated fabric so that it could be useful when adhesively bonded to other surfaces, including two pieces of the silicone resin coated fabric being bonded to each other.

FIG. 1 is a cross section of a silicone resin coated fabric produced by the method of this invention. The yarns 11 are woven or stitch bonded to form a fabric having interstices between yarns. Because many uses of the coated fabric require the coated fabric to be translucent or transparent, it is felt most practical to use fabrics which have open spaces between the yarns to allow for maximum light transmission. The yarns of the fabric can be made of any type fiber, but glass fiber and polyester fiber are preferred because of their weatherability. Glass fibers are most preferred because of their high tensile strength and dimensional stability and lack of stretch or creep when under long-time load. Before coating, the fabric is scoured in the case of polyester fibers, or heat-cleaned and finished in the case of glass fibers, in order to remove the organic lubricants used during the fiber forming and fabric weaving or stitching. These organic materials tend to yellow under weathering, thereby lowering the transparency of the coated cloth. They can also attract moisture into the yarns, which can degrade the fibers.

The fabric yarns 11 are coated with a silicone elastomer 12 to coat the individual fibers to prevent them from abrading each other, to prevent water from wicking into the yarns, and to help distribute loads placed upon the coated fabric to the fibers. The silicone elastomer 12 is present in sufficient amount to form a continuous membrane which is reinforced by the fabric. By a membrane, it is understood that the interstices of the fabric are filled in by the silicone elastomer. A subsequent coating of elastoplastic organopolysiloxane resin coated on both sides of the elastomer coated fabric would produce two separate layers of resin, one layer on each side of the membrane with no connection of resin between the two resin layers such as would be formed if the elastomer merely coated the yarns and did not fill in the interstices.

Because the silicone elastomer is present to impregnate and coat the fibers in the fabric, it is preferred that the silicone elastomer consist essentially of a polydiorganosiloxane having a viscosity of greater than 1 Pa.s at 25° C., a reinforcing silica filler, and a cure system for the elastomer to give a cured elastomer. It is preferred that the cured elastomer have a durometer of less than 30 on the Shore A scale because such low durometer silicone elastomers normally have a low modulus and high elongation, properties which are felt desirable in selecting an elastomer to impregnate and coat the yarns of the fabric. Because the silicone elastomer is in contact with the fibers in the fabric, it is preferred, particularly when the fibers are glass fibers, that the silicone elastomer not contain extending fillers which are abrasive, such as the commonly used ground quartz. The cure system used in the silicone elastomer can be any of the well known curing systems for silicone elastomer. Preferred systems are moisture curing systems with an alkyltriacetoxysilane crosslinker and an alkyltindicarboxylate catalyst being most preferred. A commercial moisture curing silicone elastomer sealant that gives off acetic acid upon curing has been found to be a useful elastomer for impregnating and coating fabric of glass fibers. Sufficient elastomer is applied to fill in the interstices between the fabric yarns. The preferred amount of elastomer is that amount sufficient to produce a coated fabric with a nominal thickness of about twice that of the thickness of the uncoated fabric. As the thickness of the elastomer is increased, the flexibility and resistance to loss of strength upon folding or creasing increases. The maximum elastomer thickness is about 5 times the uncoated fabric thickness. More could be applied, but it would serve no useful purpose.

The silicone elastomer 12 is coated by an elastoplastic organopolysiloxane resin 13 which serves to form a smooth, dirt resistant surface for the coated fabric to which dirt does not adhere. The elastoplastic organopolysiloxane resin can be any of the well known elastoplastic organopolysiloxane resins such as those containing silicone block copolymers such as those disclosed in U.S. Pat. No. 3,280,214, issued Oct. 18, 1966, to Mitchell; U.S. Pat. No. 3,328,481, issued Jun. 27, 1967, to Vincent; U.S. Pat. No. 3,629,228, issued Dec. 21, 1971 to Hartlein and Olsen; and U.S. Pat. No. 3,639,155, issued Feb. 1, 1972 to Hartlein and Vincent, said patents being incorporated by reference to show the block copolymers and their method of manufacture. A preferred elastoplastic organopolysiloxane resin is the cured product obtained by exposing to atmospheric moisture a composition comprising an organosiloxane block copolymer and a fast-cure additive. A preferred fast cure additive is an aminoalkoxypolysiloxane such as that described in U.S. Pat. No. 3,524,900, issued Aug. 18, 1970 to Gibbon et al., hereby incorporated by reference to show the aminoalkoxypolysiloxane and its preperation. The organopolysiloxane block copolymer consists essentially of (A) 40 to 75 inclusive mole percent of diorganosiloxane units wherein the diorganosiloxane units are bonded through silicon-oxygen-silicon bonds forming a polydiorganosiloxane block having an average of from 15 to 350 inclusive diorganosiloxane units per block, said polydiorganosiloxane being at least 80 mole percent dimethylsiloxane units based on the total number of siloxane units in the polydiorganosiloxane and any remaining units being selected from the group consisting of phenylmethylsiloxane units and monomethylsiloxane units, (B) 15 to 50 inclusive mole percent organosiloxane units having an average formula $R_x^{iv}SiO_{(4-x)/2}$ where x has a value of from 1 to 1.3 inclusive and $R^{iv}$ is an organic group selected from the group consisting of aryl radicals, vinyl radicals, methyl radicals, ethyl radicals and propyl radicals, said organic groups being at least 50 percent aryl radicals based on the total number of organic groups in (B), said organosiloxane units comprise a block of at least three organosiloxane units and said organosiloxane units being selected from monoorganosiloxane units and diorganosiloxane units, and (C) 3 to 25 inclusive mole percent of end-blocking siloxane units of the formula $R'SiY_yO_{(3-y)/2}$ where y has an average value from 1.8 to 2 inclusive, R' is an organic radical selected from the group consisting of alkyl radicals having from one to five inclusive carbon atoms, phenyl radicals and vinyl radicals and Y is a monovalent radical selected from the group consisting of acetoxy radicals, alkoxy radicals having from one to five inclusive carbon atoms per radical, and radicals of the formula —O—N=X wherein X is selected from the group consisting of radicals of the formula $R''_3C$=and

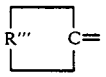

in which each R''' is selected from the group consisting of divalent hydrocarbon radicals and halogenated divalent hydrocarbon radicals and each R'' is a radical selected independently from the group consisting of monovalent hydrocarbon radicals and halogenated monovalent hydrocarbon radicals, the mole percentages of (A), (B), and (C) being based on the total number of siloxane units in the organosiloxane block copolymer. Most preferred are those resins in which (A) is present in an amount of from 50 to 70 inclusive mole percent and the polydiorganosiloxane is polydimethylsiloxane having from 25 to 100 dimethylsiloxane units per block, (B) is present in an amount of from 20 to 40 inclusive mole percent and the aryl radicals are phenyl radicals and (C) is present in an amount of from 4 to 20 inclusive mole percent. By elastoplastic it is meant that the cured resin has an elongation at break of at least 50 percent. The cured resin has a smooth dry surface which does not attract or hold dirt, thus the coated fabric remains clean and does not loose transparency or translucency when exposed to the atmosphere. Without the resin surface, the silicone elastomer coated fabric would attract and hold dirt, loosing it's transparency or translucency and having a dirty, unsatisfactory appearing surface.

When the elastoplastic organopolysiloxane resin is coated over the silicone elastomer, an interface 14 is formed. In this invention, this interface is an adhesive bond derived from a combination comprising (i) polydiorganosiloxane of the formula $X(R_2SiO)_aSiR_2X$ where R is a monovalent hydrocarbon radical containing no more than 6 carbon atoms, X is a condensable endblocking group, and a has a value such that the polydiorganosiloxane has a viscosity of greater than 1 Pa.s at 25° C.; (ii) a hydroxyl radical containing, solid, benzene soluble resin copolymer consisting essentially of $R_3SiO_{\frac{1}{2}}$ units and $SiO_{4/2}$ units where R is as defined above, there being from 0.6 to 0.9 inclusive $R_3SiO_{\frac{1}{2}}$ unit for every $SiO_{4/2}$ unit, at least 95 percent of all R radicals in (ii) being methyl; and (iii) a condensation catalyst for (i) and (ii). A preferred combination for producing the adhesive bond comprises 100 parts by weight of the polydiorganosiloxane (i), from 10 to 150 parts by weight of the resin copolymer (ii), and a catalytic amount of the catalyst (iii).

The adhesive bond at the interface 14 is necessary in the silicone resin-coated fabric of this invention because the elastoplastic organopolysiloxane resin forming the surface of the silicone resin-coated fabric must be bonded to the underlying silicone elastomer 12 so firmly that when the surface of the silicone resin-coated fabric is adhesively bonded to another surface, such as when forming a seam between two pieces of the silicone resin-coated fabric, and the bond is physically stressed, the forces do not cause a bond failure at the interface. In some previous constructions, the resin, coated on both sides of the fabric, extended through the open interstices between the silicone elastomer coated yarns and thus mechanically held the resin coating in place when it was stressed. The present construction does not have any other means of holding the resin and elastomer together other than the adhesive bond at the interface.

The adhesive bond at the interface can be formed by having the ingredients (i), (ii), and (iii) as ingredients of the silicone elastomer membrane at the interface. The adhesive bond at the interface can also be formed by having the ingredients (i), (ii), and (iii) as ingredients of a primer composition between the silicone elastomer layer and the elastoplastic organopolysiloxane resin, said composition being less than 0.1 mm thick, preferably from 0.01 to 0.07 mm.

Ingredient (i) is any of the polydiorganosiloxanes falling under the above formula. R is a monovalent hydrocarbon radical containing no more than 6 carbon atoms such as methyl, ethyl, and phenyl, with methyl being preferred. X is a condensable endblocking group, meaning that X is condensable with the hydroxyl radical of (ii). X is a condensable radical such as hydroxyl, alkoxy, carboxy, aminoxy, amido, amino, and oximo as well as the radical $—OSiRY^2$ wherein R is as defined above and Y is a condensable radical such as hydroxyl, alkoxy, carboxy, aminoxy, amido, amino, and oximo. Preferred condensable radicals are hydroxyl, alkoxy such as methoxy and ethoxy, and carboxy such as acetoxy. X may also be the radical $—OSiRX_2$ in which R and X are as defined above. The $—OSiRY_2$ radical is produced, for instance, when a hydroxyl endblocked polydiorganosiloxane is mixed with an excess of an alkyltrialkoxysilane or an alkyltriacyloxysilane. The polymer can have a viscosity of from greater than 1 Pa.s at 25° C. up to and including gums such as greater than 10,000 Pa.s at 25° C. The manufacture of these linear polyorganosiloxanes is well known to those skilled in the art.

Ingredient (ii) is a known resin copolymer which has been used as an ingredient in silicone pressure sensitive adhesives. It is described in U.S. Pat. No. 2,736,721, issued Feb. 28, 1956, to Dexter and in U.S. Pat. No. 2,814,601, issued Nov. 26, 1957, to Currie and Keil, both of which are incorporated by reference to describe ingredient (ii) and how to manufacture it. A preferred method of manufacture of ingredient (ii) is that described in U.S. Pat. No. 2,676,182, issued Apr. 20, 1954 to Daudt and Tyler. Briefly, the method of Daudt and Tyler comprises reacting under acidic conditions, a silica hydrosol with organo substituted siloxanes, for example, hexamethyldisiloxane, or hydrolyzable organosubstituted silanes, for example, trimethylchlorosilane, or their mixtures and recovering a benzene soluble resin copolymer having $R_3SiO_{\frac{1}{2}}$ units (M) and $SiO_{4/2}$ units (Q).

Regardless of the method of preparation, the weight of the resin copolymer (ii) and the ratio of M units to Q units in the resin copolymer (ii) that is used in this invention is based on the non-volatile portion of the resin copolymer. To determine the non-volatile portion of the resin copolymer a known weight of resin copolymer, as prepared, preferably dissolved in a volatile solvent such as toluene or xylene is heated at 150° C. for 3 hours to yield a residue. The non-volatile portion of the resin copolymer is the residue. The amount of the non-volatile portion of the resin copolymer is often based on the weight of the organic solvent solution of the resin copolymer and is expressed as "percent solids".

The R groups in the M units of (ii) which may be identical or different, are monovalent hydrocarbon radicals containing no more than six carbon atoms such as alkyl radicals such as methyl, ethyl, and isopropyl; cycloaliphatic radicals such as cyclopentyl and cyclohexenyl; olefinic radicals, such as vinyl and allyl; and the phenyl radical. Typical M units are $Me_3SiO_{\frac{1}{2}}$, $EtMe_2SiO_{\frac{1}{2}}$, and $EtPhMeSiO_{\frac{1}{2}}$ where Me is methyl, Et is ethyl, and Ph is the phenyl radical. Up to 0.5 percent of all R radicals in (ii) can be olefinically unsaturated, such as vinyl. The Q units in (ii) are siloxane units containing no silicon bonded carbon atoms and are derived directly from the silica hydrosol in the preferred method of Daudt and Tyler. It should be understood that the resin copolymers (ii) that are operable in this invention have as much as 3 to 4 percent by weight, based on the total weight of (ii), of hydroxyl radicals bonded directly to the silicon atom of the Q units, the amount of said hydroxyl radicals being dependent upon the method of preparation of the resin copolymer.

Resin copolymers (ii) that are operable in this invention are soluble in benzene and have a ratio of M units to Q units whose value is from 0.6:1.0 to 0.9:1.0. The M/Q ratio in (ii) can be determined by one or more standard analytical techniques such as elemental analysis, infra-red spectroscopy, nuclear magnetic reasonance spectroscopy, etc. For example, in a resin copolymer having only trimethylsiloxane units and silica units, a knowledge of the percent by weight of carbon in the resin copolymer (ii) is sufficient to establish its M/Q ratio.

The preferred resin copolymer for use in this invention is obtained when copolymer (ii) consists essentially of $Me_3SiO_{\frac{1}{2}}$ units and $SiO_{4/2}$ units. It is to be understood that trace amounts of diorganosiloxane units and monoorganosiloxane units are within the scope of this invention as components in resin copolymer (ii).

Ingredient (iii) is a condensation catalyst for the condensation of the X radical of (i) with the hydroxyl radicals of (ii). Such catalysts are well known in the art. Preferred are amines and metal carboxylates with tin carboxylates being most preferred. The choice of catalyst will depend upon the X radical of component (i) as well as the method used for making the adhesive bond. If the ingredients are ingredients of the silicone elastomer membrane at the interface, the ingredients, including the catalyst (iii), must be compatible with the other ingredients of the silicone elastomer. A preferred catalyst, for use when (i), (ii), and (iii) are ingredients of the silicone elastomer where (i) contains methyl radicals and X is an alkyldiacetoxysiloxy radical, is a dilkyltindicarboxylate with dibutyltindiacetate most preferred. When the ingredients (i), (ii), and (iii) are ingredients of a primer composition, the preferred catalyst is an amine with from 1 to 3 parts by weight of 3-(2-aminoethylamino) propyltrimethoxysilane being preferred when (i) is a hydroxyl endblocked polydimethylsiloxane gum having a viscosity of greater than 10,000 Pa. at 25° C.

FIG. 2 illustrates an embodiment of this invention in which the ingredients (i), (ii), and (iii) are ingredients of the silicone elastomer membrane at the interface. The fabric reinforcement is made up of the yarns 11 which are impregnated and coated by silicone elastomer layer 12 which, in this embodiment, coats the yarn but does not fill in the interstices of the fabric. In this embodiment, silicone elastomer used for the first layer 12 preferrably has a durometer after curing of less than 30 on the Shore A scale. Because this layer is used to impregnate the yarn, it is preferred that it be applied as a solvent solution such as 25 to 50 parts by weight of silicone elastomer dispersed in 50 to 75 parts by weight of solvents such as toluene. The silicone elastomer is preferably made with a polymer having a viscosity of from 1 to 50 Pa.s at 25° C. because such an elastomer has a low durometer and a low viscosity so that the yarns of the fabric are completely impregnated and the individual fibers are coated and protected from each other.

After curing the first layer 12, the second layer of silicone elastomer 21 is applied. The second layer 21 is present in sufficient amount to coat the first layer and to close the interstices of the fabric. Together the first layer and the second layer form the silicone elastomer membrane reinforced with fabric; and form one side of the interface 14. In this embodiment, ingredients (i), (ii), and (iii) are ingredients of the second layer of the two layers used to form the silicone elastomer membrane. The second layer is preferably applied from a solvent solution having a higher solids content than that used in the first layer, for instance from 40 to 60 parts by weight of silicone elastomer dispersed in from 40 to 60 parts by weight of solvent. The silicone elastomer of the second layer can be the same or different than the silicone elastomer of the first layer except the second layer must contain ingredients (i), (ii), and (iii) because they must be present at the interface 14. The total thickness of first layer 12 and second layer 21 falls within the same limitations discussed above for the embodiment having only a single layer of silicone elastomer. The elastoplastic organopolysiloxane 13 is applied over this two layer silicone elastomer membrane in the same manner as discussed above for the single layer membrane.

FIG. 3 illustrates a cross section of the two layer construction described above and shown in FIG. 2. The first layer 12 is shown impregnating and coating the fabric yarns 11 going in both a warp and fill direction as in a woven fabric. The first layer 12 does not fill the interstices between the yarns. The second layer 21 is shown coating the first layer 12 and filling the interstices between the coated yarns.

From the above discussion of the embodiment shown in FIG. 1, having a silicone elastomer membrane reinforced with fabric in which the silicone elastomer membrane comprises a single layer, and the embodiment shown in FIG. 2, in which the silicone membrane comprises a first and a second layer, it is understood that the silicone elastomer membrane reinforced with fabric can comprise multiple coats. The preferred embodiments have a construction similar to that discussed above. The coating applied to impregnate and coat the fibers of the yarn has a durometer of less than 30 on the Shore A scale when cured, and silicone elastomer forming the interface with the elastoplastic organopolysiloxane resin forms an adhesive bond derived from the combination comprising (i), (ii), and (iii). There can be any number of layers used in between the first coat of silicone elastomer and the last coat at the interface. The preferred number of layers are two because this is the most economical means of providing the requirements for the silicone elastomer in contact with the fibers of the yarn, and with the elastoplastic organopolysiloxane to form the interface.

FIG. 4 illustrates an embodiment of this invention in which the silicone elastomer membrane reinforced with fabric comprises a first layer 12 and second layer 21 of silicone elastomer coated over the fabric yarns 11 and a primer coating 31. The primer coating 31 comprises ingredients (i), (ii), and (iii) and is in contact with the elastoplastic organopolysiloxane resin 13 to form the interface 14. In practice the combination of layers 12 and 21 could be any number of layers. Preferably the silicone elastomer used for these layers has a durometer of less than 30 on the Shore A scale, and the layers are applied as solvent dispersions, particularly the first layer used to impregant and coat the filaments of the yarn.

The primer layer 31 comprising (i), (ii), and (iii) is preferably applied as a solvent solution because this is the most practical means of yielding the required thin layer of less than 0.1 mm thickness. A preferred primer composition comprises 100 parts by weight of hydroxyl endblocked polydiorganosiloxane (i) having a viscosity of greater than 10,000 Pa.s at 25° C. with all methyl radicals, from 80 to 120 parts by weight of a benzene soluble resin copolymer (ii) in which all the radicals are methyl and (i) and (ii) are reacted together, and (iii) is from 1 to 3 parts by weight based upon 100 parts by weight of (i) and (ii) of 3-(2-aminoethylamino) propyltrimethoxysilane. The mixture of (i), (ii), and (iii) is dispersed in a solvent to give a solids content of about from 15 percent to 30 percent to yield the proper primer thickness.

After curing, the primer layer is coated with the elastoplastic organopolysiloxane resin layer 13, which is cured to complete the construction of the silicone resin-coated fabric. FIG. 4 illustrates the method of this invention preferred at this time.

The ingredients used in the method of this invention to yield the various embodiments of this invention have been discussed above. The method of coating the fabric with the various layers can be by any of the well known coating methods for silicone elastomers and silicone resins. A preferred method of coating the silicone elastomer layers is by passing the fabric, or previously coated fabric, through a bath of the catalyzed elastomer dispersed in solvent to give the desired coating thickness, then heating to drive off the solvent and aid in curing the elastomer coating. In those cases in which the elastomer is cured by exposure to moisture, the hot air should contain moisture, preferably by injection of steam into the oven to aid in cure of the elastomer. The silicone elastomer layer can be applied in one, two, or more layers. The outer layer, at least, containing ingredients (i), (ii), and (iii) may by tacky when it comes from the curing oven, before it is coated with the elastoplastic organopolysiloxane resin. If so, the surface of the coated fabric is covered with a release sheet so that the fabric can be rolled up for storage. To continue the method, the release sheet is removed, and the elastoplastic organopolysiloxane resin is coated over the silicone elastomer and cured. The cure times and temperatures are dependent upon such variables as coating thickness, choice of solvent if used, temperature used, and air humidity for those systems curing on exposure to moisture. Times in the range of 5 to 15 minutes at temperatures of from 80° to 130° C. have been found useful.

The various embodiments of the method of this invention, used to produce the various embodiments of the silicone resin-coated fabric of this invention discussed above, have been referred to in the above discussion of the various figures illustrating the silicone resin-coated fabric of this invention. Those skilled in the art will readily be able to produce the various embodiments from the above teaching of the various methods.

The method of this invention yields a silicone resin-coated fabric which is useful for constructing structures such as air supported and tension supported roofs in which pieces of the silicone resin-coated fabric are adhesively bonded to each other or to other surfaces. In such constructions, the layers of the coated fabric must adhere to each other with sufficient strength to provide a useful product. The layers in the silicone resin-coated fabric of this invention provide such a degree of adhesion between each other. When tested by bonding pieces of the silicone resin-coated fabric together with a silicone adhesive, the resulting bonded seam, when tested, fails between the adhesive and the elastoplastic organoplastic resin surface of the coated fabric rather than between the layers of the silicone resin-coated fabric.

Following are examples illustrating the method of this invention and the silicone resin-coated fabric produced and its properties. The examples are included for illustrative purposes and should not be construed as limiting the invention which is properly set forth in the appended claims.

All parts in the following examples are parts by weight.

EXAMPLE 1

A glass fiber fabric was coated in accordance with the method of this invention to produce a silicone resin-coated fabric suitable for use in air supported roofs.

The glass fiber fabric was a commercial fabric, Style 1589 by Burlington Industries, which had been heat cleaned to remove the starch sizing used during weaving and had been finished with an epoxide-functional trimethoxysilane. The fabric had a nominal thickness of 0.48 mm.

A first coating solution was prepared by mixing 30 parts of a low viscosity flowable, acetoxy cured room temperature curing sealant with 70 parts of solvent. The sealant was the product obtained by mixing 90 parts of a hydroxyl endblocked polydimethylsiloxane fluid having a viscosity of about 2 Pa.s at 23° C. with 4.5 parts of fumed silica having a surface area of about 150 $m^2/g$. After thorough mixing the reinforced fluid was mixed with 5.4 parts of a mixture of 100 parts by weight of a 50/50 mixture of methyltriacetoxysilane and ethyltriacetoxysilane with 0.5 parts of dibutyltindiacetate. The sealant had a viscosity of about 45 Pa.s and, when cured, a Shore A durometer of about 25.

The glass fiber fabric was dipped into the first coating solution to thoroughly impregnate the fabric yarns. After dipping, the coated and impregnated fabric was dried and cured in a forced air oven at a temperature of between 85° and 100° C. for 10 minutes. The fabric yarns were impregnated and coated, but the fabric interstices were open.

A second coating solution was prepared by mixing 50 parts of the sealant used in the first coating solution with 50 parts of toluene.

The fabric, coated with the first coating, was then dipped into the second coating solution, dried, and cured at 85° to 100° C. for 10 minutes. The twice coated fabric was now fully coated in that the fabric interstices were filled with the elastomeric sealant and the coated fabric surface was a continuous surface over the fabric.

A third coating solution was prepared by mixing 33 parts of a silicone mixture, 0.4 parts of aminopropyltriethoxysilane, and 66.6 parts of toluene. The silicone mixture consisted of the product obtained by mixing 27.4 parts of the hydroxyl endblocked polydimethylsiloxane fluid described above in the first coating solution, with 29.7 parts of a solid benzene soluble resin copolymer consisting essentially of trimethylsiloxy units and $SiO_2$ units in a ratio of about 0.77 to 1. The resin had a hydroxyl content of about 2.8 percent by weight. The resin was used as a 70 percent by weight solution in xylene, the resin solution, diluted to 60 percent solids had a viscosity of about 0.03 Pa.s at 23° C. with a specific gravity of about 1.036. The silicone mixture also contained 6.3 parts of resin copolymer obtained by treating the above type of resin copolymer with hexamethyldisilazane to remove hydroxyl radicals and replace them with trimethylsilyl radicals, 2.3 parts of isopropanol, a total of 34.2 parts of xylene, and 0.14 parts of a reaction product of 115 parts of tetramethylguanidine, 144 parts of 2-ethylhexanoic acid and 1,036 parts of xylene. The silicone mixture contained 43.3 percent polydimethylsiloxane fluid and 56.7 percent resin on a solids basis.

The third coat was applied to the previously twice coated fabric by dipping into the third coating solution, then drying and curing at 100° to 125° C. for 10 minutes to give a primer thickness of about 0.038 mm. Because the third coating was tacky after curing, it was rolled up by placing a release coated paper over the tacky surface before rolling.

A fourth coating solution was prepared by mixing 85.5 parts of an organopolysiloxane block copolymer resin solution, 0.42 parts of a fast cure additive consisting of trimethylsiloxy endblocked poly(dimethylaminoethoxy)methylsiloxane, and 14 parts of toluene. The organopolysiloxane block copolymer resin solution consisted of a block copolymer containing about 26.4 mole percent phenylsiloxy units, 60.5 mole percent dimethylsiloxy units, and 13.1 mole percent methylmethoxysiloxy units; 3.5 parts of methyltrimethoxysilane; 0.41 parts of tetrabutyltitanate; and 20 parts of toluene. The resin solution had a solids content of about 75 percent by weight.

The fourth coat was applied to the previously coated fabric by first removing the release paper, then dipping the coated fabric through the fourth coating solution, drying, and curing at 100° to 110° C. for 10 minutes, to yield a fiberglass fabric having the fibers impregnated and coated with a cured elastomer having a Shore A durometer of less than 30 in an amount sufficient to fully impregnate and coat the fabric to yield a continuous elastomer surface over the fabric, the elastomer surface being coated with catalyzed silicone mixture as a primer which was subsequently coated with an elastoplastic organopolysiloxane resin composition comprising silicone block copolymer resin, crosslinker, and catalyst.

The final coated fabric had a nominal thickness of 0.94 mm with a tensile strength in the warp direction of 7943 kg/m of width and of 7336 kg/m of width in the fill direction. The flexibility of the fabric was evaluated by folding it back upon itself then rolling the fold with a 5 lb. roller. Then the fold was reversed and rolled again. The procedure was repeated 10 times, alternating sides. The tensile strength was then measured. In this case the tensile strength after folding was 4463 kg/m in the warp direction or a retention from the original fabric tensile of 56 percent. In the fill direction the tensile strength after folding was 5513 kg/m for a retention of 75 percent. The bonding of the resin coat to the coat under it was evaluated by preparing a 180° peel sample by adhering two sheets of the coated fabric together using a room temperature curing, moisture activated, silicone adhesive to bond the surfaces together. After the adhesive had fully cured, a period of about 7 days, the sample was pulled in a tensile machine in the manner described in ASTM D 1000 at a rate of 51 mm per minute on strips that were 25.4 mm wide. The sample, when peeled apart, failed at a load of 214 kg/m of width. The failure was between the room temperature curing adhesive and the elastoplastic organopolysiloxane resin surface of the coated cloth. The layers of coating on the cloth were therefore bonded together with a strength exceeding this value.

EXAMPLE 2

A comparative example of coated fabric was tested which did not contain the third coat of Example 1, which coat contained the solid, benzene soluble resin copolymer.

The comparative example was a commercially prepared coated sheet which consisted of the same finished glass fiber fabric of Example 1. The first coat was the same as in Example 1 except the cure temperature was between 80° and 100° C. The second coat was the same as in Example 1 except the second coating solution was 60 parts of the sealant and 40 parts of toluene and the cure temperature was 80° to 100° C. The third coat of this example was the same as the fourth coat of Example 1, except it was cured at a temperature of from 95° to 110° C.

The final coated fabric had a nominal thickness of 1.0 mm. When tested in the 180° peel strength test, the fabric failed at a load of 64 kg/m of width, the failure being between the elastoplastic organopolysiloxane resin layer and the elastomer layer under it. It is considered that a structural fabric should have a 180° peel strength of at least 175 kg/m of width in order to be useful in a system in which the seams in the coated fabric are formed by lapping the cloth and bonding with adhesives.

EXAMPLE 3

When the method of Example 1 is followed wherein the primer layer is the silicone mixture of Example 1 catalyzed with 2 percent aminopropyltriethoxysilane as a 10 percent solution in toluene or as a 10 percent solution in chlorothene, the silicone elastomer and the elastoplastic organopolysiloxnae are bonded together.

EXAMPLE 4

When the pressure sensitive adhesive of Example 1 is added to the silicone sealant solution of Example 1 in amounts of from 23 percent to 64 percent by weight on a solids basis, giving from 12 percent to 34 percent of the solid, benzene soluble resin copolymer and from 2.5 percent to 3.74 percent of the trimethylsilyl treated resin copolymer, and the modified elastomer is used to form the silicone elastomer membrane, which is then coated with the elastoplastic organoplastic resin, the adhesive bond at the interface is sufficient to meet the requirements of this invention.

EXAMPLE 5

When the silicone solution of Example 1 is modified by adding from 57 percent by weight to 30 percent by weight on a solids basis of the solid benzene soluble resin copolymer of Example 1 and the modified solution is used to form the silicone elastomer coating at the interface with the elastoplastic organopolysiloxane resin coated over it, the cured, resin coated fabric meets the requirements of this invention.

EXAMPLE 6

When the silicone sealant solution of Example 1 is modified by adding from 0.05 percent to 1 percent of aminopropyltriethoxysilane and the modified solution is used to form the silicone elastomer coating at the interface with the elastoplastic organopolysiloxane resin coated over it, the cured, resin coated fabric peels apart between the silicone elastomer layer and the elastoplastic orgnopolysiloxane resin layer when the coated fabric is tested.

EXAMPLE 7

When the silicone sealant solution of Example 1 is modified by adding from 0.5 percent to 2 percent on a solids basis of methacryloxypropyltrimethoxysilane, a commercial material used as a primer and additive to promote bonding, or when an epoxide functional silane is used in place of the methacryl functional silane, and the modified solution is used as in Example 6, the resin-coated fabric peels apart between the silicone elastomer layer and the elastoplastic organopolysiloxane resin layer when the coated fabric is tested.

That which is claimed is:

1. A silicone resin-coated fabric comprising an elastoplastic organopolysiloxane resin coated silicone elastomer membrane reinforced with fabric, the elastoplastic organopolysiloxane resin and the silicone elastomer membrane forming an interface which is an adhesive bond derived from a combination comprising (i) polydiorganosiloxane of the formula $$X(R_2SiO)_aSiR_2X$$

where R is a monovalent hydrocarbon radical containing no more than 6 carbon atoms, X is a condensable endblocking group, and a has a value such that the polydiorganosiloxane has a viscosity of greater than 1 Pa.s at 25° C., (ii) a hydroxyl radical containing, solid, benzene soluble resin copolymer consisting essentially of $R_3SiO_{\frac{1}{2}}$ units and SiO4/2 units where R is as defined above, there being from 0.6 to 0.9 inclusive $R_3SiO_{\frac{1}{2}}$ unit for every $SiO_{4/2}$ unit, at least 95 percent of all R radicals in (ii) being methyl, and (iii) a condensation catalyst for (i) and (ii).

2. The silicone resin-coated fabric of claim 1 in which the adhesive bond is derived from a combination comprising 100 parts by weight of the polydiorganosiloxane (i), from 10 to 150 parts by weight of the resin copolymer (ii), and a catalytic amount of the catalyst (iii).

3. The silicone resin-coated fabric of claim 2 in which (i), (ii), and (iii) are ingredients of the silicone elastomer membrane at the interface.

4. The silicone resin-coated fabric of claim 2 in which (i), (ii), and (iii) are ingredients of a primer composition between the silicone elastomer membrane and the elastoplastic organopolysiloxane resin, said composition being less than 0.1 mm thick.

5. The silicone resin coated fabric of claim 1 in which the elastoplastic organopolysiloxane resin is the cured product obtained by exposing to atmospheric moisture a composition comprising an organosiloxane block copolymer consisting essentially of (A) 40 to 75 inclusive mole percent of diorganosiloxane units wherein the diorganosiloxane units are bonded through silicon-oxygen-silicon bonds forming a polydiorganosiloxane block having an average of from 15 to 350 inclusive diorganosiloxane units per block, said polydiorganosiloxane being at least 80 mole percent dimethylsiloxane units based on the total number of siloxane units in the polydiorganosiloxane and any remaining units being selected from the group consisting of phenylmethylsiloxane units and monomethylsiloxane units, (B) 15 to 50 inclusive mole percent organosiloxane units having an average formula $$R_x^{iv}SiO_{(4-x)/2}$$

where x has a value of from 1 to 1.3 inclusive and $R^{iv}$ is an organic group selected from the group consisting of aryl radicals, vinyl radicals, methyl radicals, ethyl radicals and propyl radicals, said organic groups being at least 50 percent aryl radicals based on the total number of organic groups in (B), said organosiloxane units comprise a block of at least three organosiloxane units and said organosiloxane units being selected from monoorganosiloxane units and diorganosiloxane units, and (C) 3 to 25 inclusive mole percent of end-blocking siloxane units of the formula $$R'SiY_yO_{(3-y)/2}$$

where y has an average value from 1.8 to 2 inclusive, R' is an organic radical selected from the group consisting of alkyl radicals having from one to five inclusive carbon atoms, phenyl radicals and vinyl radicals and Y is a monovalent radical selected from the group consisting of acetoxy radicals, alkoxy radicals having from one to five inclusive carbon atoms per radical, and radicals of the formula —O—N=X wherein X is selected from the group consisting of radicals of the formula

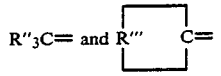

in which each R''' is selected from the group consisting of divalent hydrocarbon radicals and halogenated divalent hydrocarbon radicals and each R'' is a radical selected independently from the group consisting of monovalent hydrocarbon radicals and halogenated monovalent hydrocarbon radicals, the mole percentages of (A), (B) and (C) being based on the total number of siloxane units in the organosiloxane block copolymer.

6. The silicone resin-coated fabric claim 5 in which (A) is present in an amount of from 50 to 70 inclusive mole percent and the polydiorganosiloxane is polydimethylsiloxane having from 25 to 100 dimethylsiloxane units per block, (B) is present in an amount of from 20 to 40 inclusive mole percent and the aryl radicals are phenyl radicals and (C) is present in an amount of from 4 to 20 inclusive mole percent.

7. The silicone resin-coated fabric of claim 3 in which the fabric comprises yarn of polyester or glass fiber woven or stitch bonded into a fabric having interstices between the yarns, and the silicone elastomer membrane comprises at least a first and a second layer, the first layer being a cured silicone elastomer having a durometer of less than 30 on the Shore A scale and present in an amount sufficient to impregnate and coat the yarn but not sufficient to close the interstices of the fabric and the second layer forming one side of the interface between the silicone elastomer and the elastoplastic organopolysiloxane resin and present in an amount sufficient to close the interstices of the fabric.

8. The silicone resin-coated fabric of claim 4 in which the fabric comprises yarn of polyester or glass fiber woven or stitch bonded into a fabric having interstices between the yarns, and the cured silicone elastomer membrane comprises at least a first and second layer, the first layer being a cured silicone elastomer having a durometer of less than 30 on the Shore A scale and present in an amount sufficient to impregnate and coat the yarns but not sufficient to close the interstices of the fabric, the second layer being a cured silicone elastomer having a durometer of less than 30 on the Shore A scale and present in an amount sufficient to close the interstices of the fabric.

9. The silicone resin-coated fabric of claim 8 in which the condensation catalyst (iii) comprises from 1 to 3 parts by weight based upon 100 parts by weight of (i) and (ii) of 3-(2 aminoethylamino)propyltrimethoxysilane.

10. The silicone resin coated fabric of claim 9 in which R is methyl, X is hydroxyl radical, and a has a value such that (i) has a viscosity of greater than 10,000 Pa.s at 25° C.

11. The silicone resin-coated fabric of claim 7 in which the R radicals of (i) are methyl and X is an alkyldiacetoxysiloxy radical, the R radicals of (ii) are methyl, and the condensation catalyst (iii) comprises an alkyltindicarboxylate.

12. The silicone resin-coated fabric of claim 11 in which the second layer also contains an organotrialkoxysilane.

13. A method of producing a silicone resin-coated fabric comprising coating a fabric with sufficient curable silicone elastomer composition to form a continuous coating over the fabric, the surface of the coating being a combination comprising (i) polydiorganosiloxane of the formula $$X(R_2SiO)_aSiR_2X$$

where R is a monovalent hydrocarbon radical containing no more than 6 carbon atoms, X is a condensable endblocking group, and a has a value such that the polydiorganosiloxane has a viscosity of greater than 1 Pa.s at 25° C., (ii) a hydroxyl radical containing, solid, benzene soluble resin copolymer consisting essentially of $R_3SiO_{\frac{1}{2}}$ units and $SiO_{4/2}$ units where R is as defined above, there being from 0.6 to 0.9 inclusive $R_3SiO_{\frac{1}{2}}$ units for every $SiO_{4/2}$ unit, at least 95 percent of all R radicals in (ii) being methyl, and (iii) a condensation catalyst for (i) and (ii)

curing the coating to form a membrane; then coating the membrane with an elastoplastic organopolysiloxane resin thus forming an interface between the membrane and the resin; and finally, curing the resin.

14. The method of claim 13 in which (i) is 100 parts by weight, (ii) is from 10 to 150 parts by weight, and (iii) is a catalytic amount.

15. The method of claim 14 in which (i), (ii), and (iii) are ingredients of the curable silicone elastomer at the interface between the curable silicone elastomer and the elastoplastic organopolysiloxane resin.

16. The method of claim 15 in which the fabric comprises yarn of polyester or glass fiber woven or stitch bonded into a fabric having interstices between the yarns and in which the curable silicone elastomer is applied in at least a first and second layer, the first layer being coated over the fabric in an amount sufficient to impregnate and coat the yarn but not sufficient to close the interstices of the fabric, the silicone elastomer used for the first layer having a durometer of less than 30 on the Shore A scale, the first layer being cured, then coated with the second layer, the second layer forming one side of the interface between the curable silicone elastomer and the elastoplastic organopolysiloxane resin.

17. The method of claim 13 in which the elastoplastic organopolysiloxane resin is the cured product obtained by exposing to atmospheric moisture a composition comprising an orgnaosiloxane block copolymer consisting essentially of (A) 40 to 75 inclusive mole percent of diorganosiloxane units wherein the diorganosiloxane units are bonded through silicon-oxygen-silicon bonds forming a polydiorganosiloxane block having an average of from 15 to 350 inclusive diorganosiloxane units per block, said polydiorganosiloxane being at least 80 mole percent dimethylsiloxane units based on the total number of siloxane units in the polydiorganosiloxane and any remaining units being selected from the group consisting of phenylmethylsiloxane units and monomethylsiloxane units, (B) 15 to 50 inclusive mole percent organosiloxane units having an average formula $R_xSiO_{(4-x)/2}$ where x has a value of from 1 to 1.3 inclusive and R is an organic group selected from the group consisting of aryl radicals, vinyl radicals, methyl radicals, ethyl radicals and propyl radicals, said organic groups being at least 50 percent aryl radicals based on the total number of organic groups in (B), said organosiloxane units comprise a block of at least three organosiloxane units and said organosiloxane units being selected from monoorganosiloxane units and diorganosiloxane units, and (C) 3 to 25 inclusive mole percent of end-blocking siloxane units of the formula $R'SiY_yO_{(3-y)/2}$ where y has an average value from 1.8 to 2 inclusive, R' is an organic radical selected from the group consisting of alkyl radicals having from one to five inclusive carbon atoms, phenyl radicals and vinyl radicals and Y is a monovalent radical selected from the group consisting of acetoxy radicals, alkoxy radicals having from one to five inclusive carbon C atoms per radical, and radicals of the formula —O—N=X wherein X is selected from the group consisting of radicals of the formula

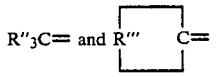

in which each R''' is selected from the group consisting of divalent hydrocarbon radicals and halogenated divalent hydrocarbon radicals and each R'' is a radical selected independently from the group consisting of monovalent hydrocarbon radicals and halogenated monovalent hydrocarbon radicals, the mole percentages of (A), (B) and (C) being based on the total number of siloxane units in the organosiloxane block copolymer.

18. The method of claim 17 in which (A) is present in an amount of from 50 to 70 inclusive mole percent and the polydiorganosiloxane is polydimethylsiloxane having from 25 to 100 dimethylsiloxane units per block, (B) is present in an amount of from 20 to 40 inclusive mole percent and the aryl radicals are phenyl radicals and (C) is present in an amount of from 4 to 20 inclusive mole percent.

19. A method of producing a silicone resin-coated fabric comprising coating a fabric with sufficient curable silicone elastomer composition to form a continuous coating over the fabric, curing the coating to form a membrane, then coating the cured silicone membrane with a primer composition, the primer composition comprising (i) polydiorganosiloxane of the formula $X(R_2SiO)_aSiR_2X$ where R is a monovalent hydrocarbon radical containing no more than 6 carbon atoms, X is a condensable endblocking group, and a has a value such that the polydiorganosiloxane has a viscosity of greater than 1 Pa.s at 25° C., (ii) a hydroxyl radical containing, solid, benzene soluble resin copolymer consisting essentially of $R_3SiO_{\frac{1}{2}}$ units and $SiO_{4/2}$ units where R is as defined above, there being from 0.6 to 0.9 inclusive $R_3SiO_{\frac{1}{2}}$ units for every $SiO_{4/2}$ unit, at least 95 percent of all R radicals in (ii) being methyl, and (iii) a condensation catalyst for (i) and (ii) then curing the primer, the cured primer composition being less than 0.1 mm thick, then coating the cured primer composition with an elastoplastic organopolysiloxane resin, thus forming an interface between the cured primer and the resin, and finally, curing the resin.

20. The method of claim 19 in which the elastoplastic organopolysiloxane resin is the cured product obtained by exposing to atmospheric moisture a composition comprising an orgnaosiloxane block copolymer consisting essentially of (A) 40 to 75 inclusive mole percent of diorganosiloxane units wherein the diorganosiloxane units are bonded through silicon-oxygen-silicon bonds forming a polydiorganosiloxane block having an average of from 15 to 350 inclusive diorganosiloxane units per block, said polydiorganosiloxane being at least 80 mole percent dimethylsiloxane units based on the total number of siloxane units in the polydiorganosiloxane and any remaining units being selected from the group consisting of phenylmethylsiloxane units and monomethylsiloxane units, (B) 15 to 50 inclusive mole percent organosiloxane units having an average formula $R_xSiO_{(4-x)/2}$ where x has a value of from 1 to 1.3 inclusive and R is an organic group selected from the group consisting of aryl radicals, vinyl radicals, methyl radicals, ethyl radicals and propyl radicals, said organic groups being at least 50 percent aryl radicals based on the total number of organic groups in (B), said organosiloxane units comprise a block of at least three organosiloxane units and said organosiloxane units being selected from monoorganosiloxane units and diorganosiloxane units, and (C) 3 to 25 inclusive mole percent of end-blocking siloxane units of the formula $R'SiY_yO_{(3-y)/2}$ where y has an average value from 1.8 to 2 inclusive, R' is an organic radical selected from the group consisting of alkyl radicals having from one to five inclusive carbon atoms, phenyl radicals and vinyl radicals and Y is a monovalent radical selected from the group consisting of acetoxy radicals, alkoxy radicals having from one to five inclusive carbon atoms per radical, and radicals of the formula —O—N=X wherein X is selected from the group consisting of radicals of the formula

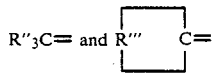

in which each R''' is selected from the group consisting of divalent hydrocarbon radicals and halogenated divalent hydrocarbon radicals and each R'' is a radical selected independently from the group consisting of monovalent hydrocarbon radicals and halogenated monovalent hydrocarbon radicals, the mole percentages of (A), (B) and (C) being based on the total number of siloxane units in the organosiloxane block copolymer.

21. The method of claim 20 in which (A) is present in an amount of from 50 to 70 inclusive mole percent and the polydiorganosiloxane is polydimethylsiloxane having from 25 to 100 dimethylsiloxane units per block, (B) is present in an amount of from 20 to 40 inclusive mole percent and the aryl radicals are phenyl radicals and (C) is present in an amount of from 4 to 20 inclusive mole percent.

22. The method of claim 19 in which (i) is 100 parts by weight, (ii) is from 10 to 150 parts by weight, and (iii) is a catalytic amount.

23. The method of claim 16 in which the fabric comprises yarn of polyester or glass fiber woven or stitch bonded into a fabric having interstices between the yarns, and in which the curable silicone elastomer is applied in at least a first and second layer, the first layer being coated over the fabric in an amount sufficient to impregnate and coat the yarn but not sufficient to close the interstices of the fabric, the silicone elastomer used for the first layer having a durometer of less than 30 on the Shore A scale, the first layer being cured, then coated with the second layer, the second layer being coated over the first layer in a amount sufficient to close the interstices of the fabric, the silicone elastomer used for the second layer having a durometer of less than 30 on the Shore A scale, the second layer being cured, then coated with the primer.

24. The method of claim 20 in which R is methyl, X is hydroxyl radical, a has a value such that (i) has a viscosity of greater than 10,000 Pa.s at 25° C., and (iii) comprises from 1 to 3 parts by weight based upon 100 parts by weight of (i) and (ii) of 3-(2 aminoethylamino)-propyltrimethoxysilane.

* * * * *

UNITED STATES PATENT AND TRADEMARK OFFICE

CERTIFICATE OF CORRECTION

PATENT NO. : 4,489,127

DATED : December 18, 1984

INVENTOR(S) : Beth Irene Gutek and Bernard VanWert

It is certified that error appears in the above-identified patent and that said Letters Patent is hereby corrected as shown below:

Column 1, line 19 - The word "chosed" should read "chosen"

Column 5, line 5 - The word "eration" should read "aration"

Column 5, line 65 - The word "loose" should read "lose"

Column 5, line 68 - The word "loosing" should read "losing"

Column 8, line 16 - The word "dilkyltin-" should read "dialkyltin-"

Column 8, line 21 - The word "thylamino) propyltrimethoxysilane" should read "thylamino)propyltrimethoxysilane"

Column 8, line 23 - The word "10,000 Pa." should read "10,000 Pa.s"

Column 14, line 10 - The word "SiO4/2" should read "$SiO_{4/2}$"

Column 15, line 58 - "3-(2 aminoethylamino)propyltrimethoxysi- " should read "3-(2-aminoethylamino)propyltrimethoxysi- "

UNITED STATES PATENT AND TRADEMARK OFFICE

CERTIFICATE OF CORRECTION

PATENT NO. : 4,489,127

DATED : December 18, 1984

INVENTOR(S) : Beth Irene Gutek and Bernard VanWert

It is certified that error appears in the above-identified patent and that said Letters Patent is hereby corrected as shown below:

Column 16, line 53 - The word "orgnaosiloxane" should read "organosiloxane"

Column 17, line 25 - The word "carbon C atoms" should read "carbon atoms"

Column 20, line 16 - The word "3-(2 aminoethylamino)-" should read "3-(2-aminoethylamino)-"

Signed and Sealed this

*Twenty-second* Day of *October 1985*

[SEAL]

*Attest:*

*Attesting Officer*

DONALD J. QUIGG

*Commissioner of Patents and Trademarks—Designate*